US008927112B2

(12) United States Patent
McKittrick et al.

(10) Patent No.: US 8,927,112 B2
(45) Date of Patent: Jan. 6, 2015

(54) PROTECTIVE COATINGS FOR CONTROLLED CORROSION RESISTANCE

(76) Inventors: David McKittrick, Reston, VA (US); Michael J. Cowell, Purcellville, VA (US)

( * ) Notice: Subject to any disclaimer, the term of this patent is extended or adjusted under 35 U.S.C. 154(b) by 277 days.

(21) Appl. No.: 13/292,422

(22) Filed: Nov. 9, 2011

(65) Prior Publication Data

US 2012/0114963 A1 May 10, 2012

Related U.S. Application Data

(60) Provisional application No. 61/412,020, filed on Nov. 10, 2010.

(51) Int. Cl.
*E04C 5/01* (2006.01)
*E04C 5/00* (2006.01)

(52) U.S. Cl.
CPC ..... *E04C 5/00* (2013.01)
USPC ..... 428/596; 428/659

(58) Field of Classification Search
None
See application file for complete search history.

(56) References Cited

U.S. PATENT DOCUMENTS

| | | | | | |
|---|---|---|---|---|---|
| 2,351,261 | A | * | 6/1944 | Hall | 52/155 |
| 2,889,305 | A | * | 6/1959 | Lopata | 523/463 |
| 3,173,662 | A | * | 3/1965 | Millerbernd | 256/52 |
| 3,502,303 | A | * | 3/1970 | Bishop | 256/48 |
| 4,710,062 | A | | 12/1987 | Vidal et al. | |
| 5,482,395 | A | * | 1/1996 | Gasparini | 403/384 |

* cited by examiner

*Primary Examiner* — Adam Krupicka
(74) *Attorney, Agent, or Firm* — Roberts Mlotkowski Safran & Cole P.C.

(57) ABSTRACT

The present invention provides a galvanized metal reinforcing tensile member for use in mechanically stabilized earth structures and a method for delaying an onset of corrosion of the tensile member. The tensile member includes a structurally compromised region in a portion of the tensile member and a corrosion protective coating on at least the structurally compromised region, the coating of a thickness and composition to delay an onset of corrosion at the structurally compromised region to correspond to at least that of a remainder of the tensile member.

18 Claims, 1 Drawing Sheet

PROTECTIVE COATINGS FOR CONTROLLED CORROSION RESISTANCE

BACKGROUND OF THE INVENTION

1. Field of the Invention

The present invention relates to a corrosion resistant tensile member, e.g. a metal strip, for use underground in mechanically stabilized earth (MSE) structures, such as retaining walls for bridges. More specifically, the invention provides a protective coating for controlled corrosion resistance of the tensile member and methods to construct a protectively coated corrosion resistant tensile member.

2. Description of Related Art

Retaining structures employing reinforced soil techniques such as retaining walls, bridge abutments, sea walls, revetments, steep slopes, etc. employ various types of reinforcement. One type of retaining structure, a mechanically stabilized embankment (MSE), provides a specific means of constructing retaining structure.

An MSE structure is typically formed by embedding reinforcements in granular soils at specific vertical and horizontal spacing. These reinforcements usually take the form of strips, grids, or ladders and can be made from various engineering plastics, metal (such as steel), engineering fabrics, or other types of materials. As the embankment is constructed, a portion of the stresses in the soil are transferred to the reinforcements by friction, bearing, passive resistance, or a combination of these mechanisms.

A key problem with the use of a metal as the tensile member, even a galvanized metal, is that the metal corrodes over time. Even further, with the MSE structures of the type described, the tensile member (e.g. metal plate, rod, bar, beam or the like), is embedded in the earth structure, with one end of the tensile member configured for external connection to other components, such as facings. In order to connect to the other components, the tensile member may be structurally compromised, usually by a deformity such as a bolt hole, weld, etc. The tensile member as a whole is subject to corrosion over time, by virtue of its composition; and the region compromised also corrodes at the same rate as the regions that have not been compromised. The region of structural compromise can be a region of weakness from the center of the deformity to a distal end of the tensile member. The region of structural compromise can be a region of weakness from the center of the deformity in equidistant and opposing linear spans of the tensile member. The region can further be from the center of the deformity in non-equidistant and opposing linear spans of the tensile member.

The corrosion of the tensile members can occur over time due to the electrical conductivity of the earth (which causes loss of metal due to electrolysis), the presence of minute quantities of air (which causes oxidation of metal), the presence of water (which enhances electrolysis), and the presence of salts (which enhances electrolysis). The tensile members are engineered to have a given useful lifetime, which depends on the particular application for each tensile member (e.g., retaining wall for a bridge, retaining wall for a sidewalk, sewage pier, etc.) In general, a larger (i.e., wider and thicker) tensile member is used when long-term stability is required. The problems of corrosion of the tensile member have been addressed in the past as follows.

U.S. Pat. No. 4,710,062 addresses the reinforcement of a rolled metal strip for use in stabilized earth structures. The rolled metal strip is thickened at periodic intervals along its length during formation of the strip. The strip is cut into required lengths such that each strip length has an end reinforced region through which an aperture is then formed to receive a bolt passing thorough a bracket of a facing. The strip may include transverse ribs at intervals on both faces of the strip to assist engagement with the surrounding soil. However, this configuration merely thickens the strip, and does not delay an onset of corrosion at the deformity.

There is a need in the art for a tensile member used in MSE structures that addresses the corrosion proximate the structurally compromised or weakened region of the tensile member relative to a remainder of the tensile member, particularly in the MSE structure.

SUMMARY OF THE INVENTION

The present invention provides for a coating on structurally weakened or otherwise compromised areas of an object, such that the coated area corrodes at a rate that results in a useful lifetime of the coated areas that is the same as or greater than the uncoated uncompromised areas.

In a first aspect, the present invention provides a galvanized metal reinforcing tensile member for use in mechanical stabilization of earth structures. The tensile member can include a structurally compromised region in a portion of the tensile member, and a corrosion protective coating on at least the structurally compromised region, the coating of a thickness and composition to delay an onset of corrosion at the structurally compromised region to correspond to at least that of a remainder of the tensile member.

In another aspect, the invention provides a method of delaying onset of corrosion of a galvanized metal reinforcing tensile element used in mechanical stabilization of earth structures. The method can include applying a dielectric barrier coating on at least a structurally compromised region of the tensile member, the coating of a composition and applied to a thickness to delay an onset of corrosion of the coated portion to at least that of a remainder of the tensile member.

BRIEF DESCRIPTION OF THE DRAWINGS

The accompanying drawings, which are incorporated in and constitute a part of this specification, illustrate several embodiments of the invention and, together with the written description, serve to explain various principles of the invention.

DETAILED DESCRIPTION OF THE PREFERRED EMBODIMENTS

Reference will now be made in detail to various exemplary embodiments of the invention, examples of which are illustrated in the accompanying drawings. The following detailed description is provided to give details on certain embodiments of the invention, and should not be understood as a limitation on the full scope of the invention.

Broadly speaking, the present invention provides for a coating on structurally weakened or otherwise compromised areas of an object, such that the onset of corrosion is delayed in the coated area and at a rate that results in a useful lifetime of the coated areas that is the same as or greater than the uncoated areas.

Figure 1A:
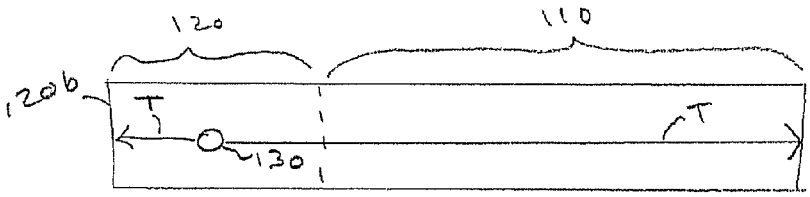
FIG. 1A depicts a top view of a tensile member, with a direction of tension indicated by arrows, in accordance with embodiments of the present teachings.
Figure 1C:
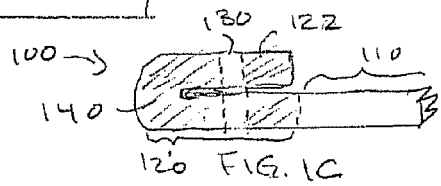
FIG. 1C is a side view of a folded tensile member in accordance with embodiments of the present teachings.
Figure 1B:
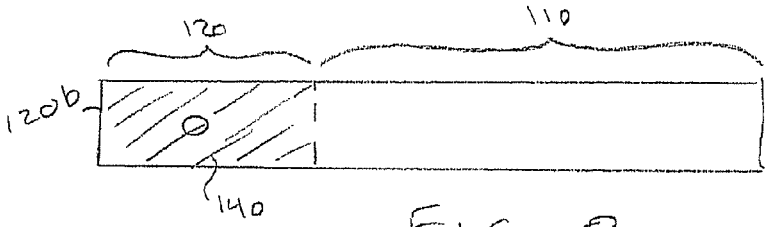
FIG. 1B depicts a top view of the tensile member of FIG. 1A with a coating applied to a weakened region of the tensile member in accordance with embodiments of the present teachings.

FIG. 1A illustrates a top view of a tensile member 100, with a direction of tension indicated by arrows, FIG. 1B illustrates a top view of a tensile member 100 including a coating 140, and FIG. 1C illustrates a side view of a folded tensile member 100, in accordance with embodiments of the present teachings. It should be readily apparent to one of ordinary skill in the art that the tensile members 100 depicted in FIGS. 1A, 1B, and 1C represent generalized schematic illustrations and that other components can be added or existing components can be removed or modified.

Figure 2:
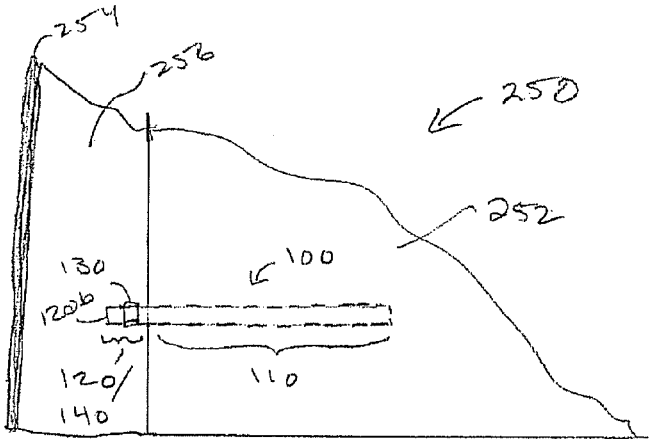
FIG. 2 depicts a cross sectional view of the tensile member of FIG. 1B the tensile member embedded in an MSE structure in accordance with embodiments of the present teachings.

The tensile member 100 can be of a length suitable for use in an MSE structure 250 (FIG. 2). The tensile member 100 can include a first length 110 and a second length 120. Although definitive lengths are indicated for each of the first length 110 and the second length 120, it will be appreciated that these lengths can vary according to the strength and material of the tensile member 100, position of a structural deformity, and various other environmental and structural factors. The coating (described subsequently with regard to FIG. 1B), however, will always be on at least a portion of the second length 120, regardless of the length, width, size, etc. of the tensile member 100.

The second length 120 of the tensile member 100 can include a structural deformity, for example a bolt hole 130, through which a bolt can be passed, and by which an additional component (not shown) can be secured to the tensile member 100. It is also expected (as shown in FIG. 1C) that the second length 120 can be folded against itself such that a folded portion 122 will align with the second length 120. In this embodiment, each of the second length 120 and the folded portion 122 can include the bolt hole 130, and a bolt (not shown) can be threaded or otherwise inserted through to secure the second length 120 to the folded portion 122. In this configuration, a bend 124 of the folded portion 122 can receive a cable or similar external component (not shown).

Tensile force is distributed in a longitudinal direction of and throughout a length of the tensile member 100 as indicated by arrows "T". The presence of the bolt hole 130 in the second length 120 of the tensile member 100 defines a deformity, or an initial point of structural weakness in the second length 120. Because of the bolt hole 130, the tensile strength of the tensile member 100 will not be uniform over the length of the tensile member. The structural weakness can be characterized as a reduction in tensile strength of the tensile member 100, and is due in part to the structural weakness inherent in placement of the bolt hole 130. The structural weakness will be in a linear direction, e.g. longitudinal direction of the tensile member 100, corresponding to a direction of application of force in the tensile member 100.

In certain applications, a region of structural weakness can be confined to the bolt hole 130. In other applications, the structural weakness can be a region of weakness from the center of the deformity (e.g. the bolt hole 130) linearly to a second end 120*b* of the tensile member 100. In yet other applications, the weakness can be a region of weakness from the center of the deformity in equidistant and opposing linear spans of the tensile member 100. In still further applications, the weakness can be a region of weakness from the center of the deformity in non-equidistant and opposing linear spans of the tensile member. Because the bolt hole 130, or similar structural deformity in the tensile member 100 will create a point or region of weakness, the weakened region will be subject to failure earlier than a remainder of the tensile member not subjected to structural weakness.

In order to achieve a useful lifetime of the weakened region (e.g. second length 120) that is consistent with the useful lifetime the first length 110, a coating 140 can be applied to the tensile member 100 as depicted in FIG. 1B. The coating 140 applied to the second length 120 can delay the onset of corrosion and delay the onset of failure of the second length relative to substantially correspond to or exceed that of the first length 110. Although the coating 140 is depicted as covering a specific area of the second length 120, it will be appreciated that the coating 140 can be configured to cover exactly that portion of the second length 120 determined to be structurally weakened. For example, the coating 140 can cover only the area immediately surrounding the bolt hole 130. Similarly, the coating 140 can cover the bolt hole 130 and the tensile member 100 only in a direction of the distal end 120*b* thereof. Further, the coating 140 can cover the bolt hole 130 and in both linear directions from the bolt hole 130 for a suitable distance. In all instances, the coating 140 will cover at least both the upper and lower surfaces of the tensile member 100 and can further coat any side surfaces in the coated areas. By coating the structurally weakened region of the tensile member, a time to failure of the second length 120 can be extended to correspond to a time to failure of at least that of the first length 110.

The coating 140 can further act as a visual indicator that the structurally weakened tensile member 100 has been coated, and thereby rendering the useful life of the weakened area (e.g. the second length 120) the same as or greater than the useful life of the first length 110. The visual indicator can also confirm that the tensile member 100 has been coated at its weakened region such that the coated region will delay an onset of failure of the second length 120 to correspond to at least that of the first length 110.

The shape of the tensile member 100 can vary. The preferred embodiment of the shape is a substantially flat strip, although any shape that will allow the exemplary function can be employed. For example, the elongated attachment members can have a cross-section that is exactly or substantially round, elliptical, oblong, square, rectangular, pentagonal, hexagonal, octagonal, etc.

The tensile member 100 can be made of any material that will allow it to function in soil reinforcement. For example, it may comprise metal, including galvanized metal, and for example zinc plated steel. The tensile member 100 of galvanized metal can be of a thickness of about 3 to about 5 millimeters, for example.

The coating 140 can be of a composition and applied to a thickness to delay an onset of failure (e.g. corrosion) of the coated portion to at least that of the first length 110. In embodiments, the coating 140 can include coal tar epoxy or 100% solid structural polyurethane. Further, in exemplary embodiments, the coating 140 can be of a thickness of about 400 micrometers to about 610 micrometers. The coating can be applied with a composition and to a thickness such that a time to failure of the second length 120 comprises at least 100 years. Accordingly, the coating can be a corrosion protective substance on at least a portion of the tensile member 100, wherein the corrosion protective substance coats a region of the tensile member 100 that is structurally weaker than other regions of the tensile member 100, and wherein the amount of corrosion protective substance on the surface is an amount that delays structural failure of the tensile member 100 such that structural failure of the weaker region occurs at the same time as or subsequent to structural failure of the other regions.

FIG. 2 depicts a cross sectional view of an embodiment of the present invention. This view shows the tensile member 100, as seen through the MSE structure 250. It should be readily apparent to one of ordinary skill in the art that the embodiment depicted in FIG. 2 represents a generalized schematic illustration and that other components can be added or existing components can be removed or modified.

The tensile members 100 can be arranged in any suitable pattern within the soil that surrounds, contacts, abuts, etc. the structure to which the apparatus of the invention is connected. For example, they may be arranged in a linear fashion in the soil reinforcement process, they can form a zigzag pattern; they can form a lattice pattern or grid, or any other arrangement that will allow them to function in soil reinforcement.

The MSE structure 250 can include a first portion 252 into which the tensile member 100 is initially embedded, a retaining wall facing 254 built spaced apart from the first portion 252, an a backfill portion 256 between the first portion 252 and the retaining wall facing 254. Various parts of the MSE structure 250 can include earth, concrete, limestone, for example crushed limestone, according to a particular structure.

In keeping with the present embodiments, the first length 110 of the tensile member 100 can be embedded in the first portion 252 of the MSE structure 250, while the second length 120 of the tensile member 100 can protrude from the first portion 252 of the MSE structure 250. The second length 120 can be connected, via bolt hold 130 to the retaining wall facing 254 with external components (not shown) as known in the art. The second length 120 of the tensile member 100 can include the coating 140 over at least a portion of the second length 120. In addition, the coating 140 can cover more than just the weakened region, and can further act as an indicator that the tensile member 100 is in fact protected, by the coating, at the weakened region. In the event that only the bolt hole 130 per se constitutes the structurally weakened tensile strength, then an extension of the coating 140 over additional surface of the second length can act as the visual indicator of the strengthened bolt hole 130, when the coating might not otherwise be visible.

The present invention also provides a method of delaying corrosion of a galvanized metal reinforcing tensile element used in mechanical stabilization of earth structures. The method includes determining a weakened region of tensile member, applying a non-corrosive coating on at least the weakened portion of the tensile member, the coating of a composition and applied to a thickness to delay an onset of corrosion of the coated portion to at least that of the remainder of the tensile member other than the non-weakened region. Stated another way, the method includes coating the weakened region with a corrosion protective substance in an amount that delays the onset of corrosion by an amount of time that results in structural failure of the weakened region at the same time as or later than the remaining regions.

Unlike other attempts at extending the useful lifetime of a structurally weakened portion of a metal strip by increasing the thickness of metal at or around the weakened portion, or by otherwise adding sacrificial metal to the area, the present invention provides an external physical barrier that delays the onset of corrosion.

A variety of modifications and variations to the invention are possible within the spirit and scope of the following claims. The invention should not be considered as restricted to the specific embodiments that have been described and illustrated with reference to the drawings.

While the invention has been illustrated with respect to one or more exemplary embodiments, alterations and/or modifications can be made to the illustrated examples without departing from the spirit and scope of the appended claims. In particular, although the method has been described by examples, the steps of the method may be performed in a difference order than illustrated or simultaneously. In addition, while a particular feature of the invention may have been disclosed with respect to only one of several embodiments, such feature may be combined with one or more other features of the other embodiments as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." And as used herein, the term "one or more of" with respect to a listing of items such as, for example, "one or more of A and B," means A alone, B alone, or A and B.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any an all sub-ranges between (and including) the minimum value of zero and the maximum value of 10, that is, any and all sub-ranges having a minimum value of equal to or greater than zero and a maximum value of equal to or less than 10, e.g., 1 to 5.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

The invention claimed is:

1. A mechanically stabilized earth (MSE) structure comprising:

a galvanized metal reinforcing tensile member including a structurally compromised galvanized region in a portion of the tensile member; and a corrosion protective coating applied on at least the structurally compromised region, but not applied to a remainder of the galvanized tensile member, the coating being of a thickness and composition to delay an onset of corrosion at the structurally compromised region to correspond to at least that of the uncoated galvanized remainder of the tensile member, and an MSE portion into which the galvanized metal reinforcing structure is embedded, wherein the MSE structure subjects the tensile member to tensile forces.

2. The mechanically stabilized earth (MSE) structure of claim 1, wherein the MSE portion is at least one of the group consisting of earth, concrete, stone and crushed stone.

3. The mechanically stabilized earth (MSE) structure of claim 1, wherein the galvanized metal comprises a thickness of about 3 to about 10 millimeters.

4. The mechanically stabilized earth (MSE) structure of claim 1, wherein the structurally compromised region comprises a through-hole for placement of a bolt or other fastener/connector.

5. The mechanically stabilized earth (MSE) structure of claim 1, wherein the coating comprises a visual indicator that the member is corrosion resistant.

6. The mechanically stabilized earth (MSE) structure of claim 1, wherein the coating comprises coal tar epoxy or 100% solid structural polyurethane.

7. The mechanically stabilized earth (MSE) structure of claim 1, wherein the coating comprises a thickness of about 400 micrometers to about 800 micrometers.

8. The mechanically stabilized earth (MSE) structure claim 1, wherein a time to corrosion of the coated structurally compromised region comprises from 25 to 120 years.

9. A method of delaying onset of corrosion of a galvanized metal reinforcing tensile element used in a mechanically stabilized earth (MSE) structure, said method comprising: applying a non-corrosive coating on at least a structurally compromised galvanized region of the tensile member but not applying the coating to a remainder of the galvanized tensile member, the coating being of a composition and applied to a thickness such that an onset of corrosion of the coated portion is delayed to at least that of a remainder of the tensile member, embedding the galvanized metal reinforcing element in a portion of the MSE structure, and subjecting the tensile member to tensile forces.

10. The method of claim 9, wherein the galvanized metal comprises zinc plated steel.

11. The method of claim 9, wherein the galvanized metal comprises a thickness of about 3 to about 10 millimeters.

12. The method of claim 9, wherein the structurally compromised portion comprises a through-hole for placement of a bolt or other fastener/connector.

13. The method of claim 9, wherein the coating comprises a visual indicator that the tensile member is corrosion resistant.

14. The method of claim 9, wherein the coating serves as a physical barrier that delays corrosion of the metal of the tensile element.

15. The method of claim 9, wherein the coating comprises coal tar epoxy or 100% solid structural polyurethane.

16. The method of claim 9, wherein the coating comprises a thickness of about 400 micrometers to about 800 micrometers.

17. The method of claim 9, wherein a time to corrosion of the coated portion of the tensile member comprises from 25 to 120 years.

18. The method of claim 9, wherein the MSE portion is at least one of the group consisting of earth, concrete, stone, and crushed stone.

* * * * *